US005135320A

United States Patent [19]

Sugino

[11] Patent Number: 5,135,320

[45] Date of Patent: Aug. 4, 1992

[54] SERIAL PRINTER

[75] Inventor: Koichi Sugino, Tokyo, Japan

[73] Assignee: Seikosha Co., Ltd., Tokyo, Japan

[21] Appl. No.: 732,260

[22] Filed: Jul. 18, 1991

[30] Foreign Application Priority Data

Jul. 27, 1990 [JP] Japan ..... 2-200994

[51] Int. Cl.[5] ..... B41J 19/50

[52] U.S. Cl. ..... 400/283; 400/279; 400/303; 400/477; 400/703

[58] Field of Search ..... 400/279, 76, 283, 303, 400/703, 705, 477; 235/475, 476, 479; 395/110

[56] References Cited

U.S. PATENT DOCUMENTS 3,838,250 9/1974 Naas et al. ..... 400/705
4,856,924 8/1989 Sugino ..... 400/279
4,929,099 5/1990 Graham et al. ..... 400/76
4,983,854 1/1991 Mizuno et al. ..... 400/283
5,052,830 10/1991 Gohara ..... 400/76
5,076,718 12/1991 Sugino ..... 400/283

FOREIGN PATENT DOCUMENTS 2018707 1/1971 Fed. Rep. of Germany ..... 400/705
0174375 10/1984 Japan ..... 400/705

*Primary Examiner*—Eugene H. Eickholt
*Attorney, Agent, or Firm*—Jordan and Hamburg

[57] ABSTRACT

A serial printer comprises a movable carrier, a print head mounted on the carrier, sliders mounted to either a fixed member of the printer or the carrier and selectively slidable to a plurality of positions to select a desired print mode, a sensor mounted to the other member and movable relative to the sliders when the carrier is moved so as to sense the position of the sliders, and an initial condition control system for changing print modes in response to the position of the sliders as sensed by the sensor.

9 Claims, 4 Drawing Sheets

SERIAL PRINTER

BACKGROUND OF THE INVENTION

1. Field of the Invention

The present invention relates to a serial printer wherein a print head is mounted on a movable carrier.

2. Description of the Related Art

In a typical serial printer, initial conditions may be set up by a DIP switch.

Such a DIP switch requires that a control circuit include input ports corresponding in number to its electrodes. In addition, the DIP switch must be so located on a circuit board that it can be operated by a user. A longer wire is thus required to provide a connection between the DIP switch and the input ports. This complicates the circuit pattern of the circuit board and prevents reduction in the size of the circuit board.

SUMMARY OF THE INVENTION

Accordingly, it is an object of the present invention to provide a serial printer which simplifies the circuit pattern of a circuit board so as to reduce the size of the circuit board.

In order to achieve the foregoing object, the present invention provides a serial printer which comprises sliders mounted to one of a fixed member of the printer and a carrier and selectively slidable to a plurality of positions to select a desired print mode. A sensor is mounted to the other member and is movable relative to the sliders when the carrier is moved so as to sense the position of the sliders. An initial condition control means is provided for changing print modes in response to the position of the sliders as sensed by the sensor.

In the present invention, when the carrier is moved, the sensor is moved relative to the sliders so as to sense the position of the sliders. The initial condition control means is able to change print modes in response to the position of the sliders as sensed by the sensor.

BRIEF DESCRIPTION OF THE DRAWINGS

For a better understanding of the present invention, reference may be made to the following description of preferred embodiments when taken in conjunction with the accompanying drawings, in which.

DESCRIPTION OF THE PREFERRED EMBODIMENTS

Figure 1:
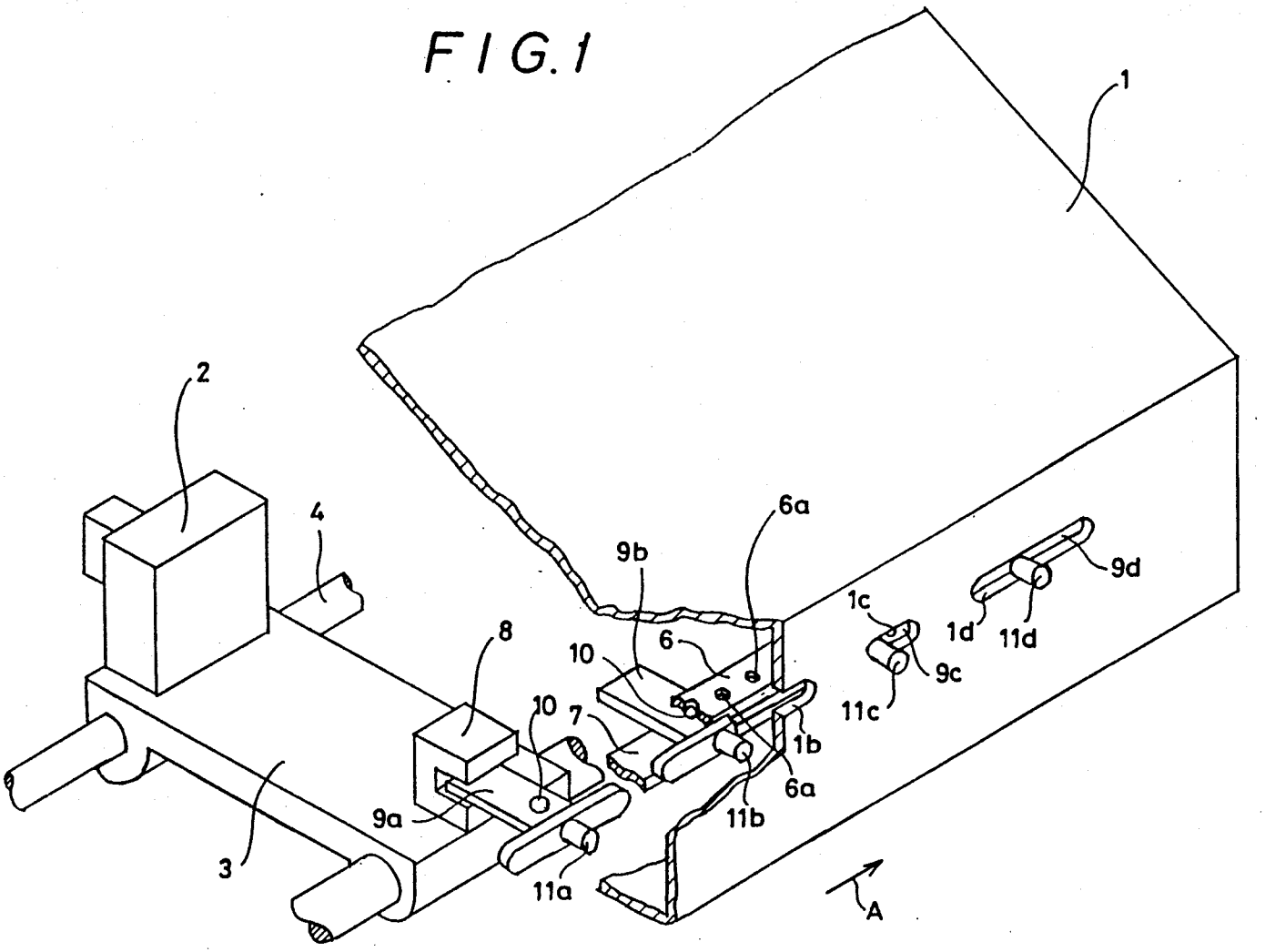
FIG. 1 is a perspective view showing a control arrangement of a serial printer according to one embodiment of the present invention.

FIG. 1 shows a serial printer according to one embodiment of the present invention.

The serial printer includes a printer case 1 within which a carrier 3 is moved along a pair of guides 4 and 5. The carrier 3 has a print head 2 thereon. Two plate-like rails 6 and 7 extend in the direction in which the carrier 3 is moved.

A sensor 8 is fixed on the carrier 3 and is thus moved with the carrier 3. In this embodiment, the sensor 8 is in the form of a photointerrupter.

The fixed rails 6 and 7 extend in parallel to one another with a predetermined space therebetween. A plurality of sliders 9*a* to 9*d* are slidably disposed between the rails 6 and 7. The rail 6 is resiliently mounted. A number of click apertures 6*a* are formed in the rail 6 at predetermined intervals.

Figure 2:
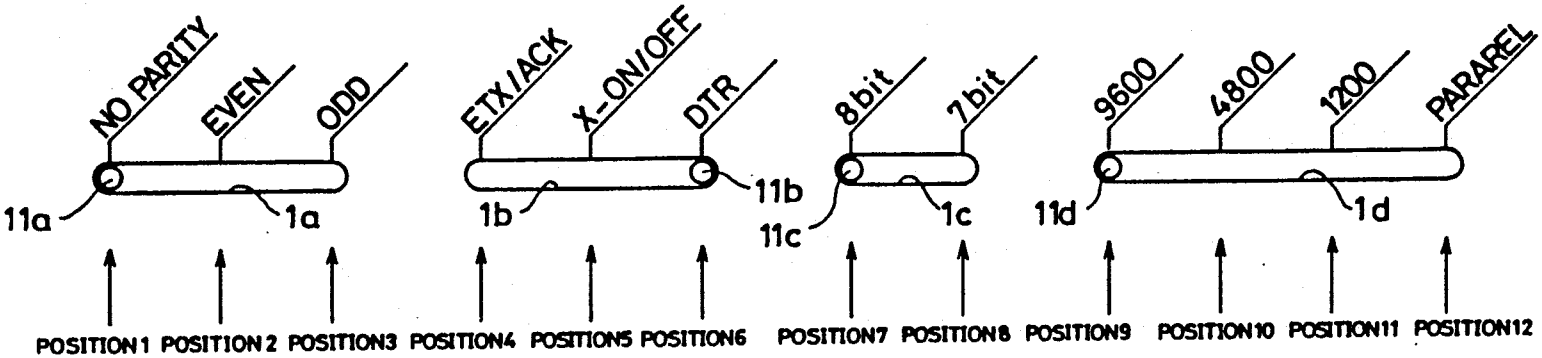
FIG. 2 is a front view showing the control panel of the serial printer.

The sliders 9*a* to 9*d* include semispherical projections 10 and cylindrical operating elements 11*a* to 11*d*, respectively. The projections 10 are engageable with the apertures 6*a* of the fixed rail 6 to lock the sliders 9*a* to 9*d* in given positions. The operating elements 11*a* to 11*d* extend out of the printer case 1. As shown in FIG. 2, the printer case 1 has a plurality of elongate holes 1*a* to 1*d* through which the operating elements 11*a* to 11*d* extend outwardly of the case 1. The elongate holes 1*a* to 1*d* are so sized that the sliders 9*a* to 9*d* can be selectively locked in a plurality of positions by moving the operating elements 11*a* to 11*d*. Twelve different print modes such as "NO PARITY", "EVEN" and "ODD" are imprinted around respective ones of the elongate holes 1*a* to 1*d* and correspond to the positions at which the sliders 9*a* to 9*d* are locked. When the operating element 11*a* is moved to "NO PARITY", for example, the slider 9*a* is located at POSITION 1. When the operating element 11*a* is moved to "EVEN", the slider 9*a* is located at POSITION 2.

When the carrier is moved, the sliders 9*a* to 9*d* are moved into a recess of the sensor 8 to block light. The sensor 8 is thus operable to sense the position of the sliders 9*a* to 9*d*.

Figure 3:
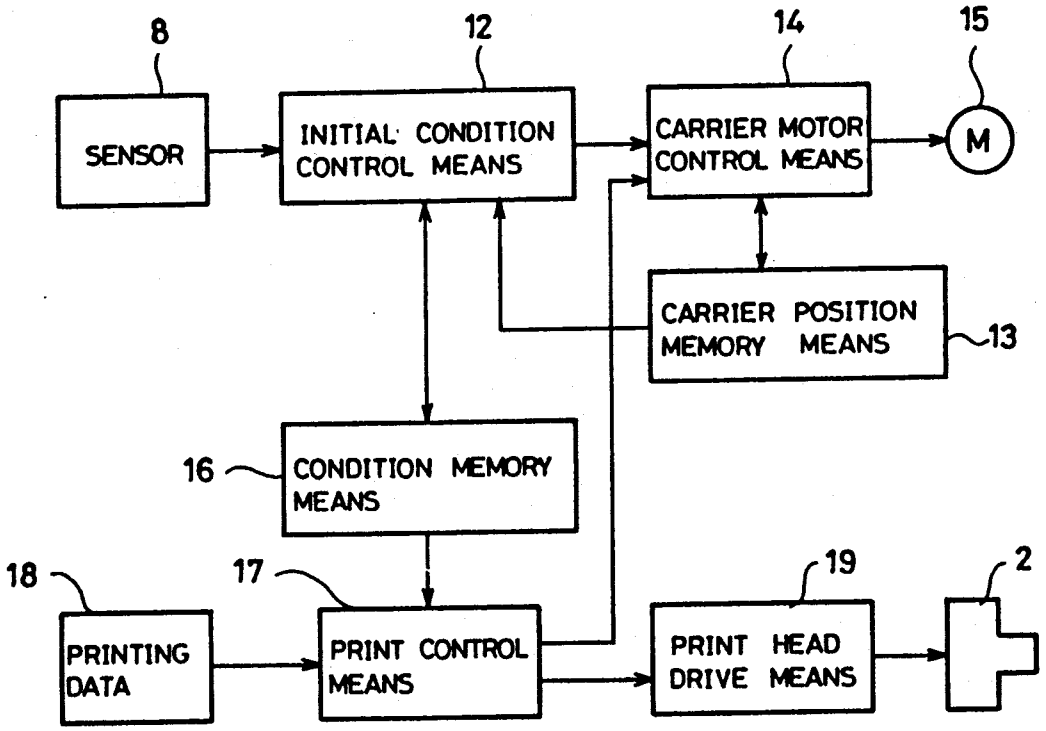
FIG. 3 is a block diagram showing a system for controlling the serial printer.

FIG. 3 is a block diagram showing a system for controlling the serial printer.

An initial condition control means 12 is operable to receive from a carrier position memory means 13 information on the position of the carrier so as to control the operation of a carrier motor 15 through a carrier motor control means 14. The control means 12 has a condition memory means 16 with information stored therein on a print mode as sensed by the sensor 8. Based on this information, a print control means 17 is operable to set up an interface. The interface is adapted to receive printing data. During a printing operation, printing data 18 is inputted to the print control means 17 to operate the carrier motor 15 and the print head 2 through the carrier motor control mean 14 and a print head drive means 19.

Figure 4:
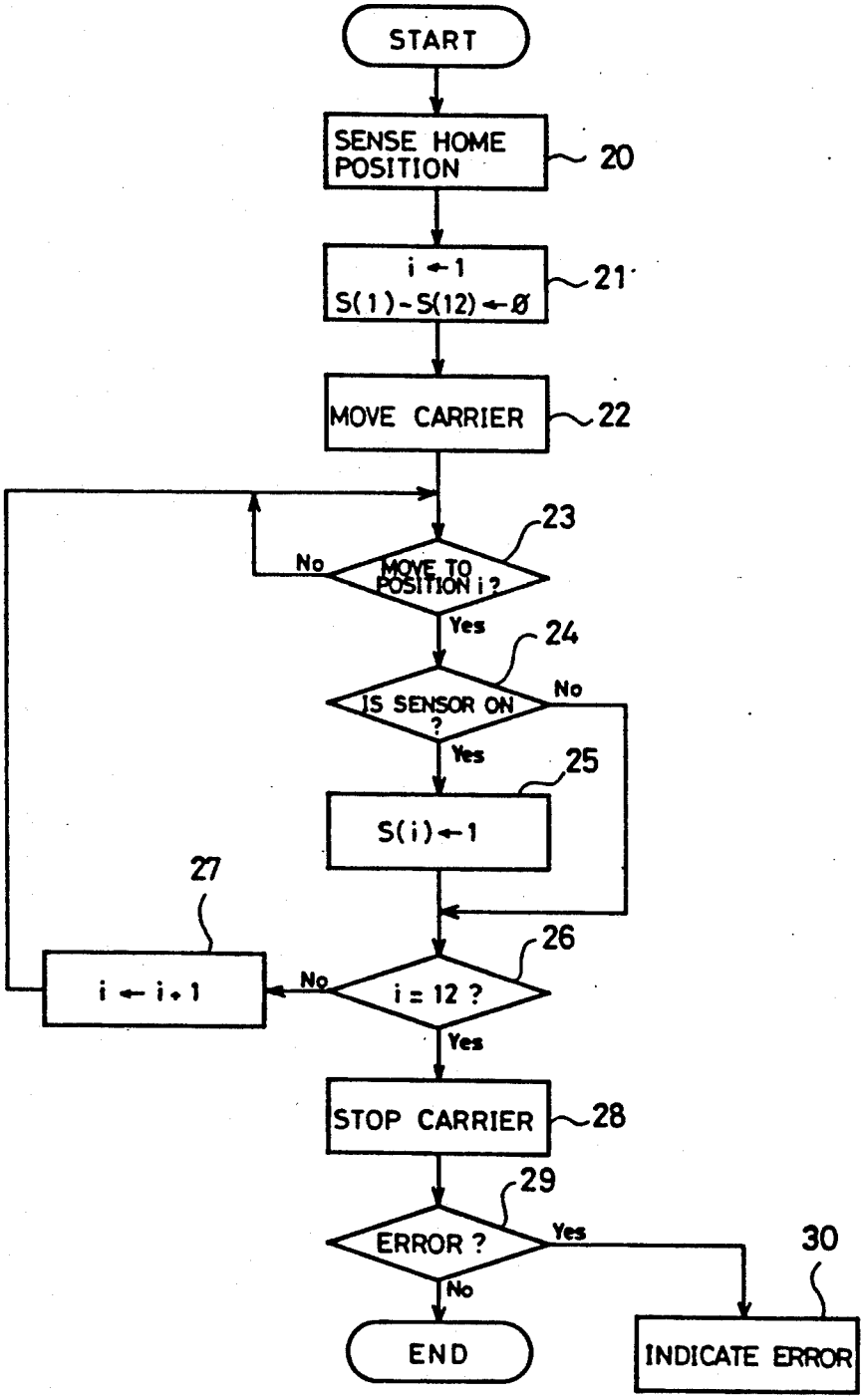
FIG. 4 is a flow chart showing the operation of initial condition control means.

FIG. 4 is a flow chart showing the operation of the initial condition control means 12. The control means 12 is rendered operative when the printer is turned on.

In a step 20, the home position of the carrier 3 is sensed.

In a step 21, an address i is set to "1", and signals s(1) to s(12) are set to "0". The address i corresponds to POSITION 1 to 12 of the sliders 9*a* to 9*d*. S(1) to s(12) are stored in the condition memory means 16 and selectively combined to control various print modes. In a step 22, the carrier 3 is moved (in the direction of the arrow A in FIG. 1) under the control of the carrier motor control means 14.

In a step 23, it is determined whether or not the carrier 3 is moved to POSITION 1. This is done by checking the contents of the carrier position memory means 13. In a step 24, it is determined whether or not the sensor 8 is on after the carrier 3 has been moved to POSITION 1. The sensor 8 is on when light from the sensor 8 is blocked by the sliders 9*a* to 9*d*. When the sensor 8 is on, in a step 25, "1" is added to the signal s(1). When the sensor 8 is off, the next step, step 26, is performed. At this time, the value of the signal s(1) remains zero. In a step 26, it is determined whether the address i is "12". If the address is not "12", in a step 27, 1 is added to make the value of the address i in a step 27, 1 is added to make the value of the address i "2". The program is then returned to the step 23 and repeated until the value of the address i becomes "12". When the value of the address is "12", a step 28 is performed wherein the carrier 3 is stopped. In a step 29, it is determined whether there are any errors. When an error is found, a step 30 is performed to indicate such an error. If one of the signals s(1) to s(3), the signals s(4) to s(6), the signals s(7) and s(8) and the signals s(9) to s(12) is one, and the rest are zero, there is no error. If not so, there is an error. In such a case, the sliders 9*a* to 9*d* are sensed to be located at two or more positions of POSITIONs 1 to 3, POSITIONs 4 to 6, POSITIONs 7 and 8, and POSITIONs 9 to 12, or to be located at no position. Such an error will then be indicated to a user. When there is no error, the program is completed.

When the program is completed, the positions of the sliders 9*a* to 9*d* are stored in the initial condition memory means 16. Based on this information, the interface is set up by the print control means 17. That is, if the sliders 9*a* to 9*d* are positioned as shown, for example, in FIG. 2, the baud rate of a serial interface is 9600 bps (bit per second), the number of data bit is eight, the protocol is DTR (data terminal ready), and there is no parity.

In this embodiment, the interface is set up. As an alternative, any initial conditions such as page length, pitch or font may be set up in the same manner.

In this embodiment, the sensor 8 is in the form of a photointerrupter. Alternatively, the sensor 8 may be a reflective photosensor or other type of sensor.

Further, in this embodiment, the sensor 8 is mounted on the carrier 3 so as to move relative to the sliders 9*a* to 9*d*. Alternatively, the sliders 9*a* to 9*d* may be mounted to the carrier 3, with the sensor 8 fixed to the printer.

In the present invention thus far described, initial conditions may be set up without the need for a DIP switch and corresponding input ports in a control circuit. This results in a decrease not only in the size of the control circuit, but also in the number of integrated circuit terminals such as gate array terminals. In addition, no wire is required to provide a connection between the DIP switch and the input ports. This facilitates the design of the circuit pattern of the circuit board and enables reduction in the size of the circuit board. The serial printer of the present invention requires a lesser number of parts, is compact, and is economical to manufacture. The serial printer is also reliable since a fewer number of integrated circuit terminals and signal patterns on the circuit board is required.

Although preferred embodiments of the present invention have been described, it is to be understood that various changes and modifications may be made without departing from the spirit and scope of the invention.

What I claim is:

1. A serial printer comprising:

a fixed printer structure means;

a print head mounted on a carrier means, said carrier means being moveably mounted on said printer structure means;

sliders slidably mounted on one of said printer structure means and carrier means and selectively slidable to a plurality of positions to select a desired print mode;

a sensor mounted on the other of said printer structure means and carrier means and movable relative to said sliders when said carrier means is moved so as to sense the position of said sliders; and initial condition control means for changing print modes in response to the position of said sliders as sensed by said sensor.

2. A serial printer comprising:

a printer structure means;

a carrier means moveably mounted on said printer structure means;

sliders moveable on one of said printer structure and carrier means to a plurality of selectable positions to select a desired print mode;

a sensor mounted on the other of said printer structure and carrier means such that movement of said carrier means on said printer structure means effects relative movement between said sliders and said sensor such that said sensor is thereby operable to sense the selected positions of said sliders; and control means for changing the print mode of the printer according to the selected positions of said sliders.

3. A serial printer according to claim 2, wherein said sensor is mounted on said carrier means and said sliders are slidably mounted on said printer structure means.

4. A serial printer according to claim 2, wherein said sliders comprise a plurality of slider elements, each of said slider elements being slidable between a plurality of selectable positions representing different printing modes.

5. A serial printer according to claim 2, wherein said sliders comprise biased detent means for biasingly retaining said sliders in a selected position.

6. A serial printer according to claim 2, wherein said sliders have engageable parts which are engageable by an operator to move said sliders to selected positions.

7. A serial printer comprising:

a fixed printer structure;

a carrier assembly including a printer head and mounted to be movable with respect to said fixed printer structure; and control means for setting up initial operating conditions of said printer, said control means comprising:

at least one control device mounted to be selectively positionable at one of a plurality of different control device positions with respect to one of said carrier assembly and printer structure, said different control device positions corresponding to different initial conditions of said printer, means for sequentially moving said carrier assembly to a plurality of different positions with respect to said printer structure, position sensing means mounted to the other of said carrier assembly and printer structure and responsive to sequential positioning of said carrier assembly by said moving means for sensing a control device position at which said control device is positioned, a memory, means for storing said sensed control device position in said memory, and means for controlling said printer in accordance with the initial printer condition corresponding to the control device position stored in said memory.

8. A serial printer according to claim 7, wherein said control device positions correspond to separate positions of said carrier assembly with respect to said printer structure, and said position sensing means comprises means for determining the position of said carrier assembly with respect to said printer structure at which said control device is sensed.

9. A serial printer according to claim 7, wherein said control device comprises a slider slidably mounted to said printer structure, and said position sensing means comprises a photoelectric sensor mounted on said carrier assembly, said sensor including a light beam and being positioned so that said slider intercepts said light beam at a control device position at which said control device is positioned.

* * * * *